US007963713B2

(12) United States Patent
Wang

(10) Patent No.: US 7,963,713 B2
(45) Date of Patent: Jun. 21, 2011

(54) LIQUID DISPENSER

(75) Inventor: Teng-Huei Wang, Tainan County (TW)

(73) Assignee: Yonyu Plastics Co., Ltd., Tainan County (TW)

( * ) Notice: Subject to any disclaimer, the term of this patent is extended or adjusted under 35 U.S.C. 154(b) by 683 days.

(21) Appl. No.: 12/115,670

(22) Filed: May 6, 2008

(65) Prior Publication Data

US 2009/0279939 A1 Nov. 12, 2009

(51) Int. Cl.
*A46B 11/04* (2006.01)
*A47L 13/22* (2006.01)

(52) U.S. Cl. ..... 401/288; 401/183; 401/281; 401/286

(58) Field of Classification Search ..... 401/183, 401/186, 187, 269, 270, 280–282, 286, 288–290
See application file for complete search history.

(56) References Cited

U.S. PATENT DOCUMENTS 4,902,152 A * 2/1990 Seidler ..... 401/288
4,930,922 A * 6/1990 LaRosa et al. ..... 401/281
4,946,302 A * 8/1990 Uchida ..... 401/288
5,803,640 A * 9/1998 Nakajima et al. ..... 401/288
7,287,927 B2 * 10/2007 Zhang ..... 401/270

* cited by examiner

*Primary Examiner* — Tuan N Nguyen
(74) *Attorney, Agent, or Firm* — Frommer Lawrence & Haug LLP; Ronald R. Santucci

(57) ABSTRACT

A liquid dispenser includes: a deformable container confining a fluid-storing space and having an open end defining an opening; an outer sleeve secured to the open end, extending into the fluid-storing space, and having an inner wall formed with a recess; an inner sleeve extending into the outer sleeve, defining an inner space, rotatable about an axis relative to the outer sleeve between first and second angular positions, and formed with a through-hole in fluid communication with the recess when the inner sleeve is disposed at the first angular position and not in fluid communication with the recess when the inner sleeve is disposed at the second angular position; and a brush-mounting seat extending into the inner sleeve.

6 Claims, 5 Drawing Sheets

LIQUID DISPENSER

BACKGROUND OF THE INVENTION

1. Field of the Invention

The present invention relates to a liquid dispenser, more particularly to a liquid dispenser defining a fluid path and including a cap rotatable to open and close the fluid path.

2. Description of the Related Art

As shown in FIG. 1, a conventional liquid dispenser 1 includes a deformable container 11 defining a liquid-storing space 110 for storing a liquid (not shown) therein, a brush unit 12 extending fittingly into the container 11, and a brush cap 13 engaging threadedly the container 11 for covering the brush unit 12.

The container 11 has a neck portion 112 confining a neck space 115 and formed with an inner diaphragm wall 114 that is formed with a liquid-discharging opening 113 in fluid communication with the liquid-storing space 110 and the neck space 115.

The brush unit 12 includes a hollow mounting seat 121 that extends fittingly into the neck space 115 and that defines a fluid passage 123 in fluid communication with the neck space 115, and a brush member 122 extending into and secured to the hollow mounting seat 121.

The brush cap 13 is threadedly engaged to an exterior of the neck portion 112 of the container 11.

In use, the brush cap 13 is removed from the container 11, and the container 11 is squeezed to push the liquid out through the liquid-discharging opening 113 and the fluid passage 123 so as to moisten the brush member 122 for a brushing operation. After use, the brush cap 13 is secured to the container 11 to cover the brush member 122 so as to prevent dust and drying of the liquid held in the brush member 122.

The conventional liquid dispenser 1 is disadvantageous in that since the liquid-storing space 110 is constantly in fluid communication with the fluid passage 123 through the liquid-discharging opening 113, the liquid may undesirably flow into the cap 13 when the container 11 is squeezed accidentally.

SUMMARY OF THE INVENTION

Therefore, an object of the present invention is to provide a liquid dispenser that can overcome the aforesaid drawback associated with the prior art.

Accordingly, a liquid dispenser of the present invention comprises: a deformable container defining a fluid-storing space therein and having an open end that defines an opening in fluid communication with the fluid-storing space; an outer sleeve secured to the open end of the container, extending into the fluid-storing space through the opening, and having an inner wall that is formed with a recess in fluid communication with the fluid-storing space; an inner sleeve extending into the outer sleeve, defining an inner space, rotatable about an axis relative to the outer sleeve between first and second angular positions, and formed with a through-hole that is in fluid communication with the inner space and that is in fluid communication with the recess when the inner sleeve is disposed at the first angular position and that is not in fluid communication with the recess when the inner sleeve is disposed at the second angular position; and a brush-mounting seat adapted to hold a brush member, extending into the inner sleeve, and defining a fluid passage that is in fluid communication with the inner space in the inner sleeve.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
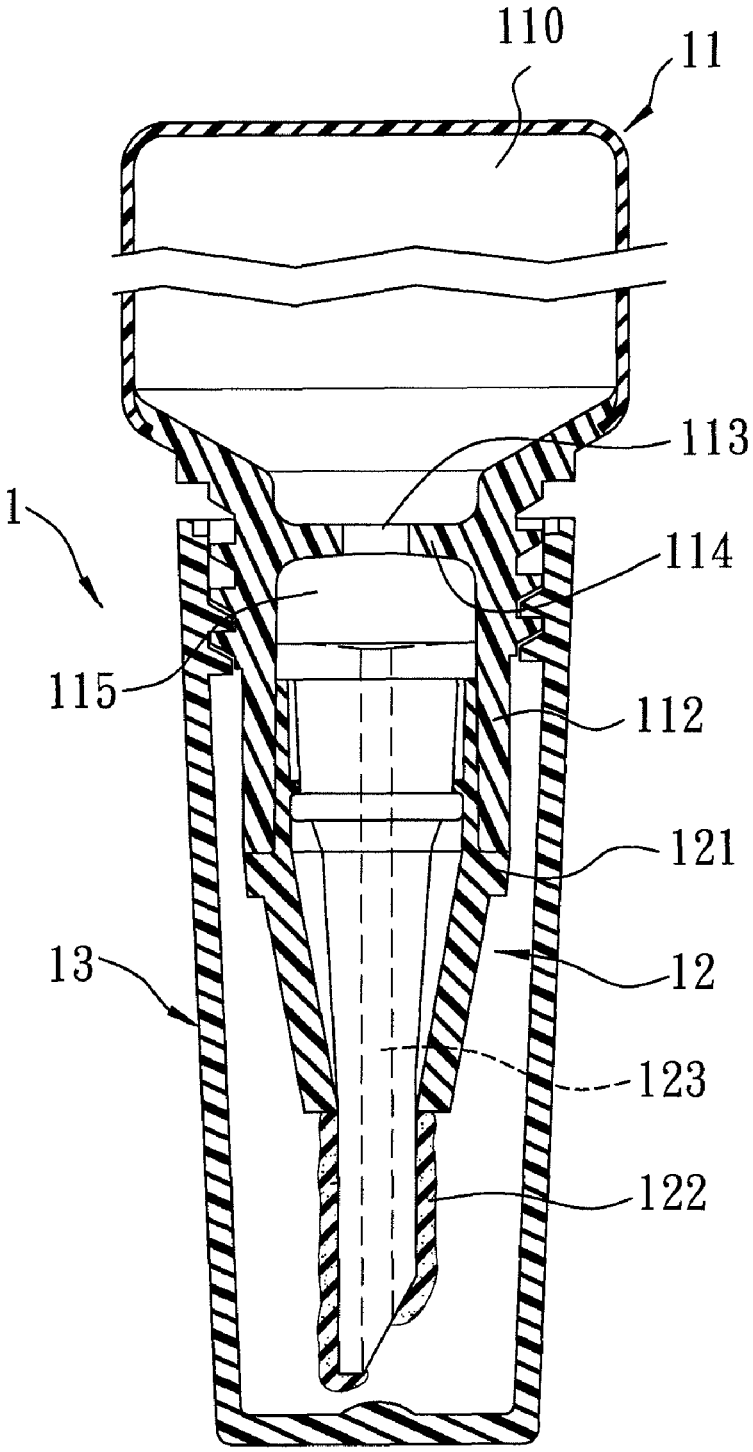
FIG. 1 PRIOR ART
FIG. 1 is a fragmentary sectional view of a conventional liquid dispenser.
Figure 2:
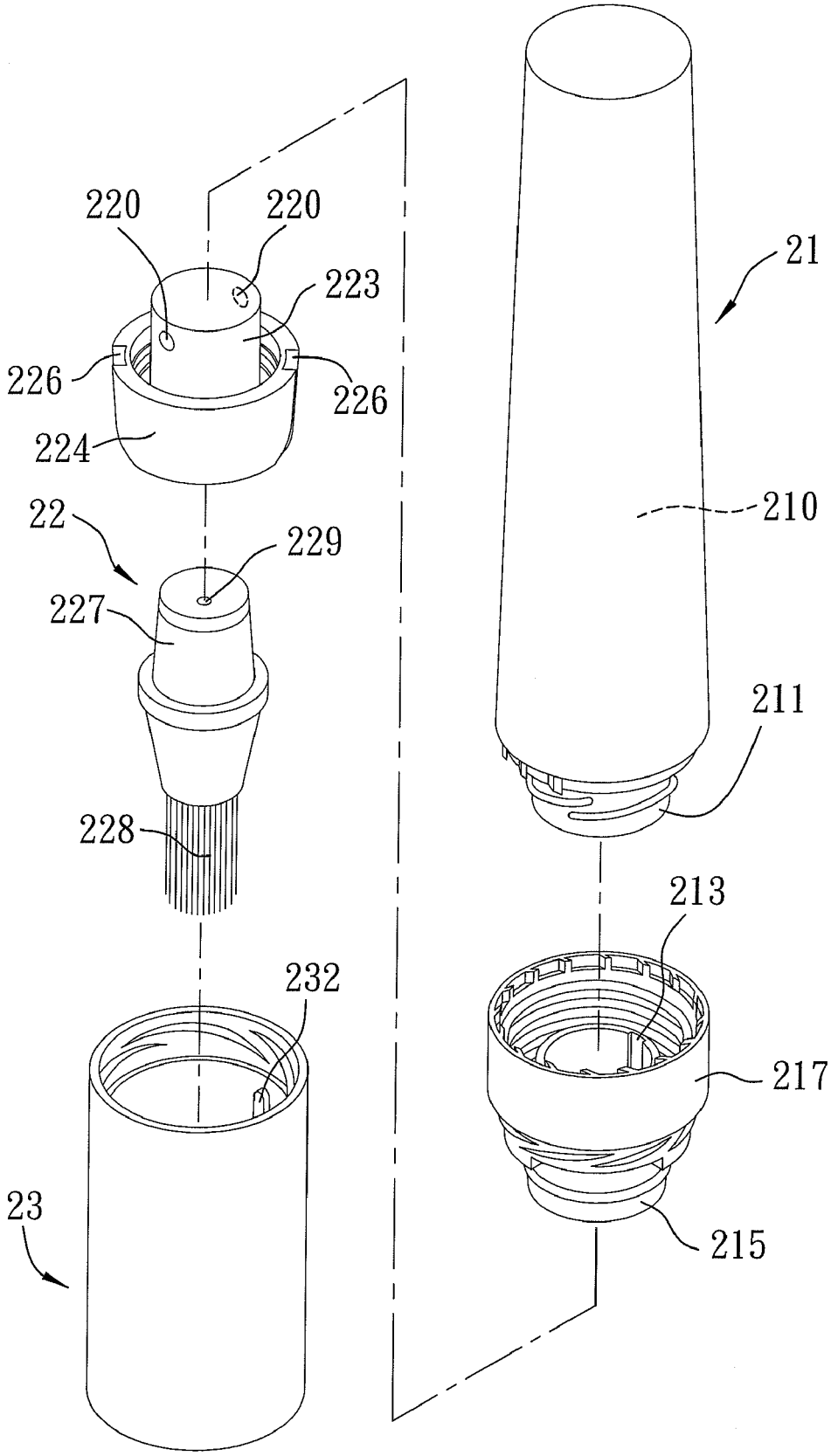
FIG. 2 is an exploded perspective view of the preferred embodiment of a liquid dispenser according to the present invention.
Figure 3:
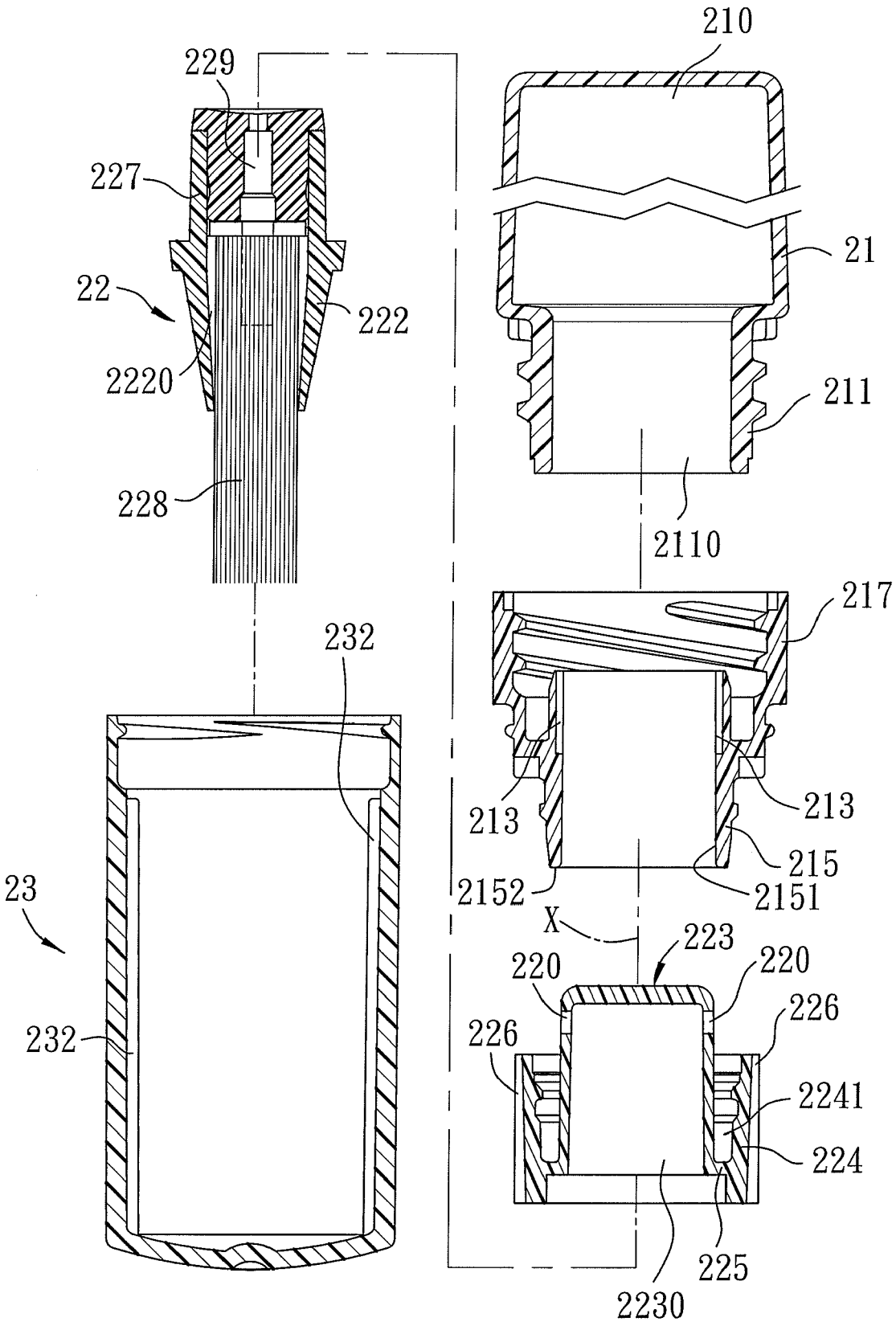
FIG. 3 is a fragmentary exploded sectional view of the preferred embodiment.
Figure 4:
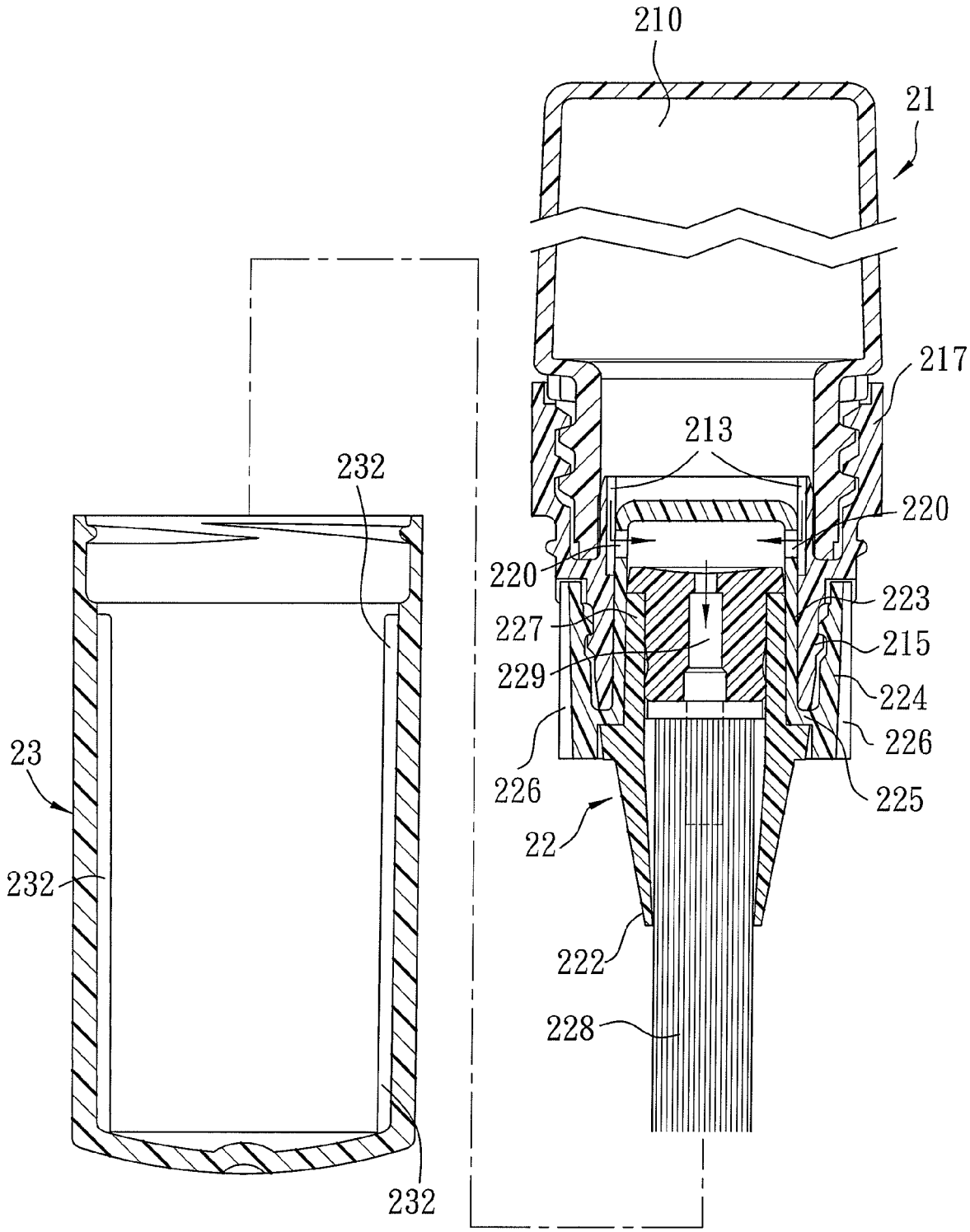
FIG. 4 is a fragmentary partly exploded sectional view of the preferred embodiment, illustrating an inner sleeve disposed at an angular position.

Referring to FIGS. 2 to 4, the preferred embodiment of a liquid dispenser according to the present invention is shown to include: a deformable container 21 defining a fluid-storing space 210 therein and having an open end 211 that defines an opening 2110 in fluid communication with the fluid-storing space 210; an outer sleeve 215 secured to the open end 211 of the container 21, extending into the fluid-storing space 210 through the opening 2110, and having an inner wall 2151 that is formed with a pair of diametrically disposed recesses 213 in fluid communication with the fluid-storing space 210; an inner sleeve 223 extending into the outer sleeve 215, defining an inner space 2230, rotatable about an axis (X) relative to the outer sleeve 215 between first and second angular positions (see FIGS. 4 and 5), and formed with a pair of diametrically disposed through-holes 220 that are in fluid communication with the inner space 2230 and that are respectively in fluid communication with the recesses 213 when the inner sleeve 223 is disposed at the first angular position and that are not in fluid communication with the recesses 213 when the inner sleeve 223 is disposed at the second angular position; and a brush-mounting seat 22 adapted to hold a brush member 228, extending into the inner sleeve 223, and defining a fluid passage 229 that is in fluid communication with the inner space 2230 in the inner sleeve 223.

Figure 5:
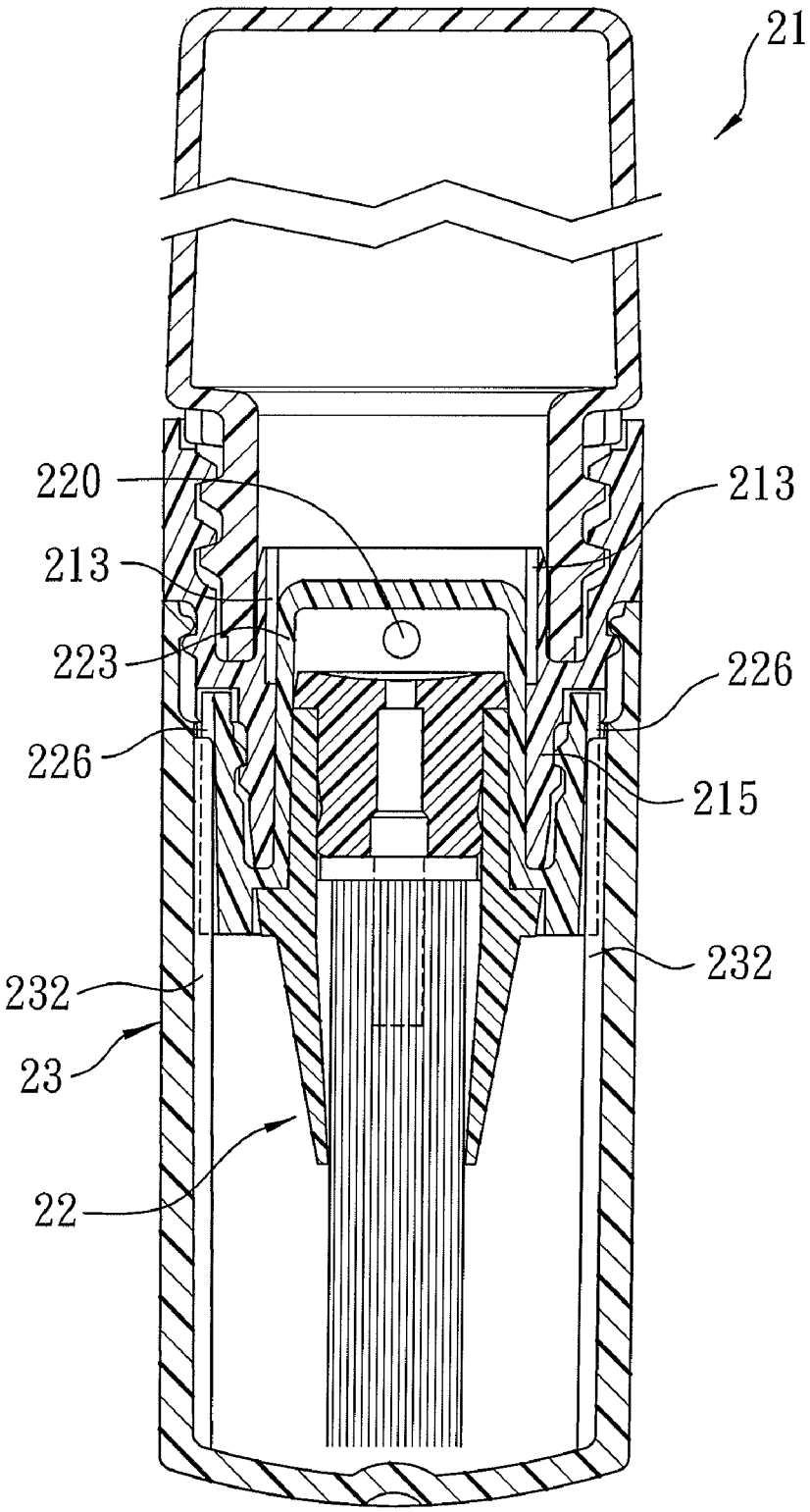
FIG. 5 is a fragmentary assembled sectional view of the preferred embodiment, illustrating the inner sleeve disposed at another angular position.

In this embodiment, the through-holes 220 in the inner sleeve 223 are aligned respectively with the recesses 213 in the outer sleeve 215 in radial directions relative to the axis (X) when the inner sleeve 223 is disposed at the first angular position, as best shown in FIG. 4, and are angularly offset from the recesses 213 in the outer sleeve 215 when the inner sleeve 223 is disposed at the second angular position, as best shown in FIG. 5.

In this embodiment, the outer sleeve 215 is formed with a first annular connector 217 surrounding a portion of the outer sleeve 215 and engaging releasably (in a thread-engaging manner) the open end 211 of the container 21. The inner sleeve 223 is formed with a second annular connector 224 surrounding a portion of the inner sleeve 223 to define a gap 2241 therebetween. The outer sleeve 215 extends into the gap 2241, and engages releasably (in a tongue-and-groove engaging manner) the second annular connector 224. The outer sleeve 215 has an outer end 2152 abutting against an annular shoulder 225 interconnecting an end of the inner sleeve 223 and the second annular connector 224.

The brush-mounting seat 22 includes a mounting connector 227 that extends fittingly into the inner space 2230 in the inner sleeve 223 and that defines a fluid passage 229, and a tapered shank 222 extending from the mounting connector 227 and confining a fluid discharging space 2220 in fluid communication with the fluid passage 229. The brush member 228 extends into and is held securely in the fluid discharging space 2220. The inner space 2230 in the inner sleeve 223 cooperates with the through-holes 220 in the inner sleeve 223 and the recesses 213 in the outer sleeve 215 and the liquid-storing space 210 in the container 21 to define a fluid path.

The liquid dispenser 2 further includes a cap 23 engaging releasably (in a tongue-and-groove engaging manner) the first annular connector 217 of the outer sleeve 215 so as to cover the brush member 228, and further engaging releasably the second annular connector 224 so as to drive rotation of the inner sleeve 223 between the first and second annular positions. The cap 23 is rotatable about the axis (X) relative to the first annular connector 217 of the outer sleeve 215.

In this embodiment, the second annular connector 224 is formed with a pair of diametrically disposed and axially extending grooves 226, and the cap 23 is formed with a pair of diametrically disposed and axially extending protrusions 232 that extend respectively into the axially extending grooves 226 so as to permit axial movement of the cap 23 relative to the second annular connector 224.

In use, the cap 23 is rotated about the axis (X) in a counterclockwise direction for about 45 degrees to dispose the inner sleeve 223 at the first angular position, and is subsequently removed from the outer sleeve 215 by disengaging the cap 23 from the first annular connector 217. When the container 2 is squeezed, the liquid contained in the fluid-storing space 210 is pushed out through the recesses 213, the through-holes 220 and the fluid passage 229 to the brush member 228 for a brushing operation.

On the other hand, when the liquid dispenser 2 is not in use, the cap 23 is brought into engagement with the first annular connector 217, and is subsequently rotated in a clockwise direction for about 45 degrees to disposed the inner sleeve 223 at the second annular position, thereby preventing the liquid in the container 21 from flowing into the cap 23 when the container 21 is undesirably squeezed.

By forming the recesses 213 in the outer sleeve 215 and the through-holes 220 in the inner sleeve 223 of the liquid dispenser of this invention, the aforesaid drawback associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A liquid dispenser comprising:

a deformable container defining a fluid-storing space therein and having an open end that defines an opening in fluid communication with said fluid-storing space;

an outer sleeve secured to said open end of said container, extending into said fluid-storing space through said opening, and having an inner wall that is formed with a recess in fluid communication with said fluid-storing space;

an inner sleeve extending into said outer sleeve, defining an inner space, rotatable about an axis relative to said outer sleeve between first and second angular positions, and formed with a through-hole that is in fluid communication with said inner space and that is in fluid communication with said recess when said inner sleeve is disposed at the first angular position and that is not in fluid communication with said recess when said inner sleeve is disposed at the second angular position; and a brush-mounting seat adapted to hold a brush member, extending into said inner sleeve, and defining a fluid passage that is in fluid communication with said inner space in said inner sleeve.

2. The liquid dispenser as claimed in claim 1, wherein said through-hole in said inner sleeve is aligned with said recess in said outer sleeve in a radial direction relative to said axis when said inner sleeve is disposed at the first angular position, and is angularly offset from said recess in said outer sleeve when said inner sleeve is disposed at the second angular position.

3. The liquid dispenser as claimed in claim 1, wherein said outer sleeve is formed with a first annular connector surrounding a portion of said outer sleeve and engaging releasably said open end of said container, said inner sleeve being formed with a second annular connector surrounding a portion of said inner sleeve to define a gap therebetween, said outer sleeve extending into said gap and engaging releasably said second annular connector.

4. The liquid dispenser as claimed in claim 3, further comprising a cap adapted for covering the brush member and engaging releasably said second annular connector so as to drive rotation of said inner sleeve between the first and second annular positions.

5. The liquid dispenser as claimed in claim 4, wherein one of said cap and said second annular connector is formed with an axially extending groove, and the other of said cap and said second annular connector is formed with an axially extending protrusion that extends into said axially extending groove so as to permit axial movement of said cap relative to said second annular connector.

6. The liquid dispenser as claimed in claim 4, wherein said cap engages releasably said first annular connector and is rotatable relative to said first annular connector.

* * * * *